US011019917B2

(12) United States Patent
Ferzli

(10) Patent No.: US 11,019,917 B2
(45) Date of Patent: Jun. 1, 2021

(54) ORAL/FACIAL CARE BRUSH WITH DISPENSER

(71) Applicant: George S. Ferzli, Staten Island, NY (US)

(72) Inventor: George S. Ferzli, Staten Island, NY (US)

( * ) Notice: Subject to any disclaimer, the term of this patent is extended or adjusted under 35 U.S.C. 154(b) by 100 days.

(21) Appl. No.: 16/661,092

(22) Filed: Oct. 23, 2019

(65) Prior Publication Data

US 2020/0352316 A1 Nov. 12, 2020

Related U.S. Application Data

(63) Continuation-in-part of application No. 16/408,700, filed on May 10, 2019, now Pat. No. 10,827,824.

(51) Int. Cl.

| | |
|---|---|
| ***A46B 11/04*** | (2006.01) |
| ***A46B 11/00*** | (2006.01) |
| ***A46B 9/04*** | (2006.01) |

(52) U.S. Cl.

CPC ..... *A46B 11/0065* (2013.01); *A46B 9/04* (2013.01); *A46B 11/002* (2013.01); *A46B 11/0003* (2013.01); *A46B 11/0037* (2013.01); *A46B 11/0058* (2013.01); *A46B 2200/1066* (2013.01)

(58) Field of Classification Search

CPC ..... A46B 11/0003; A46B 11/002; A46B 11/0037; A46B 11/0058; A46B 11/0065

See application file for complete search history.

(56) References Cited

U.S. PATENT DOCUMENTS

| | | | | |
|---|---|---|---|---|
| 4,066,367 | A | 1/1978 | Sherosky | |
| 4,427,116 | A | 1/1984 | Brown | |
| 4,786,199 | A | 11/1988 | Chen | |
| 5,144,712 | A * | 9/1992 | Hansel | A46B 7/023 15/144.4 |
| 6,002,523 | A | 12/1999 | Nettlefold | |
| 6,213,663 | B1 * | 4/2001 | Micaletti | A46B 11/0024 401/176 |
| 6,273,629 | B1 | 8/2001 | Jordan | |
| 7,074,390 | B2 | 7/2006 | MacKinnon | |
| 7,896,567 | B2 | 3/2011 | Burrowes | |
| 8,235,619 | B2 | 8/2012 | Meredith | |
| 8,496,393 | B2 | 7/2013 | Martin | |
| 8,550,739 | B1 | 10/2013 | Robbins | |
| 8,794,249 | B2 | 8/2014 | Gerber | |
| 8,864,402 | B2 | 10/2014 | Vila | |

(Continued)

FOREIGN PATENT DOCUMENTS

KR 2019097462 A * 8/2019

*Primary Examiner* — Jennifer C Chiang
(74) *Attorney, Agent, or Firm* — Jordan and Koda, PLLC

(57) ABSTRACT

A personal care brush includes a brush head portion and handle portion with an exposed groove for receiving a first container that stores one to six doses of a facial or oral care product. The groove leads to a channel that runs through the brush head to an opening at a bristle frame side of the brush head. A pushing member is manually advanced along the groove to push product from the first container into the channel and out through the opening. A member located at a backside of the brush head is movable relative to an axis of the toothbrush. The member has a first position for personal care applications and a second position for facilitating exposure of the channel for channel cleaning.

18 Claims, 9 Drawing Sheets

(56) References Cited

U.S. PATENT DOCUMENTS

| | | | | |
|---|---|---|---|---|
| 8,881,332 | B2 | 11/2014 | Noble | |
| 9,022,680 | B1 | 5/2015 | Lubyabitskiy | |
| 9,474,360 | B2 | 10/2016 | Alsalameh | |
| 9,510,664 | B2 | 12/2016 | Wen | |
| 9,826,823 | B1 | 11/2017 | Velazquez | |
| 9,918,504 | B1 * | 3/2018 | Johnson | A61F 13/104 |
| 10,010,165 | B1 * | 7/2018 | LaFortune | A46B 15/0091 |
| 10,154,728 | B2 | 12/2018 | Hailechristos | |
| 10,159,332 | B2 | 12/2018 | Moskovich | |
| 10,213,012 | B2 | 2/2019 | Jimenez | |
| 10,786,340 | B2 * | 9/2020 | Armanous-Dib | A46B 11/0062 |
| 2018/0183238 | A1 * | 6/2018 | Lim | H02J 3/14 |
| 2019/0116968 | A1 * | 4/2019 | Curry | A46B 15/0071 |

* cited by examiner

ORAL/FACIAL CARE BRUSH WITH DISPENSER

BACKGROUND OF THE INVENTION

This invention generally relates to oral care and facial care instruments, and more particularly to oral care toothbrushes and facial and eye care brushes having built-in product dispensing capability.

Toothbrushing generally involves squeezing dentifrice onto a toothbrush head prior to brushing. It is known that greater convenience can be achieved by providing a tooth brush having a built in reservoir from which the dentifrice is dispensed during brushing. Despite the appeal of such a dispensing, reservoir-filled toothbrush, and the many designs for them that have been suggested in patent literature over the past several decades, such category of toothbrush product has not become commercially popular with consumers. Some designs render the toothbrush system too costly by including electric drive train components. Other designs are less reliable and unnecessarily difficult for children to use, such as by including a bulky piston and screw design for collapsing the reservoir. Other designs render the toothbrush system too unsanitary, if not properly cleaned.

Other than convenience and ease of use, another challenge of dispensing-type toothbrushes is that of reliably transporting the dentifrice from a built-in reservoir to the toothbrush head. Typically the dentifrice has to be squeezed from a reservoir through a relatively long (compared to the neck of a toothpaste tube) but narrow conduit whose dimensions are constrained by the toothbrush neck.

The present invention overcomes the shortcomings and inconveniences of prior toothbrush configurations described above.

SUMMARY OF THE INVENTION

The personal care brush of the present invention is for dispensing a personal care product to the eyes, face or mouth from a limited dose cartridge stored in the device handle through the brush head among the brush bristles of the brush. The brush includes a brush head and an elongated body, configured as a unitary handle and head structure or as separate handle and brush head elements that are attached together. The preferred embodiment is for a toothbrush. However, other embodiments of the invention are a shaving brush, makeup brush, mascara brush, and eyebrow gel brush.

The handle portion has an exposed groove for receiving a dentrifice container that stores one to six doses of dentrifice. The groove leads to a channel that runs through the brush head to an opening at a bristle frame side of the brush head. A pushing member is manually advanced along the groove to push dentrifice from the dentrifice container into the channel and out through the opening. A latch is located at a backside of the brush head and is movable relative to an axis of the toothbrush. The latch has a first position for brushing and a second position for facilitating exposure of the channel for channel cleaning.

The pushing member runs in a track along the groove in the elongated body. When the dentrifice container is positioned in the groove, the pushing member is manually advanced along the track to squeeze dentrifice from the container into the channel. In some embodiments the elongated body is metered so that during manual movement of the pushing member one can hapticly feel when the moving member has reached a position at which one dose of dentrifice has been dispensed. Metering is implemented to provide for one or more doses, in accordance with a dosage capacity of the dentrifice container and the length of the groove.

In some embodiments one of a base support portion and a bristle frame portion of the brush head is hinged relative to the other so as to rotate about the hinge relative to the other. The latch is moved to the second position which releases the movable portion of the brush head to be moved so as to expose the channel formed between the bristle frame portion and bristle frame portion for cleaning. In another embodiment, the latch covers the channel. When the latch is moved distally, the channel underlying the latch is exposed for cleaning.

DETAILED DESCRIPTION OF THE PREFERRED EMBODIMENTS

Figure 1:
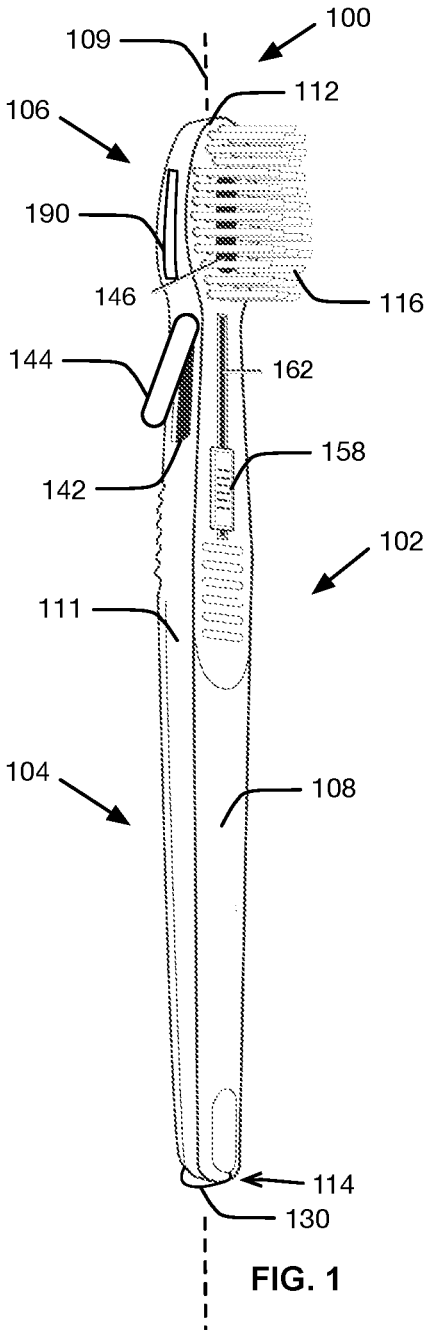
FIG. 1 is a perspective view of a toothbrush having a single dose dispensing capability, in accordance with an embodiment of the present invention.

In the following description, for purposes of explanation and not limitation, specific details may be set forth to provide a thorough understanding of the present invention. However, it will be apparent to one skilled in the art that the present invention may be practiced in other embodiments that depart from these specific details. Detailed descriptions of well-known components are omitted so as not to obscure the description of the present invention.

First Toothbrush Embodiments

Referring to FIGS. 1-10, a toothbrush 100 is illustrated in accordance with an embodiment of the present invention. The toothbrush 100 generally includes an elongated body 102 having a handle portion 104 and a head portion 106. Tooth cleaning elements 116 (e.g., bristles) extend from the head portion 106. The toothbrush 100 is intended to be used in a manner that the tooth cleaning elements 116 clean a user's teeth. Although the illustrated toothbrush 100 is in the form of a manual toothbrush, in other embodiments the toothbrush 100 may be a powered toothbrush.

The body 102 of the toothbrush 100 generally extends along a longitudinal axis 109 from a proximal end 114 to a distal end 112. Because the body 102 may, in certain embodiments, be a non-linear structure, the longitudinal axis of the body 102 may also be non-linear in certain embodiments. However, the invention is not to be so limited in all embodiments, and in certain other embodiments the body 102 may have a simple linear arrangement and thus a substantially linear longitudinal axis.

The handle portion 104 of the toothbrush 100 is an elongated structure extending from the proximal end 114 to the toothbrush head portion 106. The handle portion 104 provides the mechanism by which the user can hold and manipulate the toothbrush 100 during use. The handle portion 104 includes an outer surface that includes a front surface 108 and an opposing rear surface 110. In the exemplified embodiment, the handle portion 104 is generically depicted as being straight. However, in other embodiments the handle portion 104 may have contours for user comfort.

In the exemplified embodiment, the handle portion 104 is formed of a rigid plastic material, for example polymers and copolymers of ethylene, propylene, butadiene, vinyl compounds and polyesters such as polyethylene terephthalate. In other embodiments the handle portion 104 can be formed of any material that is not incompatible with the dentrifice that is stored therein. The handle portion 104 also may include a resilient material, such as a thermoplastic elastomer, as a grip cover that is molded over portions of or the entirety of the handle portion 104 to enhance gripping of the handle portion 104 during use. For example, portions of the handle portion 104 that are typically gripped by a user's palm during use may include a thermoplastic elastomer or other resilient material to further increase user comfort.

The head portion 106 of the toothbrush 100 is coupled to the handle portion 104 and includes a front surface 117 and an opposing rear surface 119. In the exemplified embodiment, the head portion 106 is formed integrally with the handle portion 104 as a single unitary structure using a molding, milling, machining or other suitable process. However, in other embodiments the handle portion 104 and the head portion 106 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Typically, the head portion 106 is formed by any of the materials described above for the handle portion 104.

The head portion 106 of the toothbrush 100 has a plurality of tooth cleaning elements 116 (e.g., bristles) extending from the front surface 117. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 116 are connected to the head portion 106 in any manner known in the art. For example, staples/anchors, in-mold tufting (IMT) or anchor free tufting (AFT) could be used to mount the cleaning elements/tooth engaging elements to the head portion 106. In AFT, a plate or membrane having tuft holes therein is formed separately from the body 102 of the toothbrush 100. Bristles or other tooth cleaning elements are positioned within the tuft holes. The free ends of the bristles on one side of the plate or membrane perform the cleaning function. The ends of the bristles on the other side of the plate or membrane are melted together by heat to be anchored in place. After the bristles are properly coupled to the head plate, the head plate is secured to the brush head such as by ultrasonic welding.

In an exemplary embodiment the toothbrush 100 is hollow having an inner cavity 120 extending from an opening 128 at the proximal end 114 to a closed end in the head portion 106 toward the distal end 112 of the toothbrush 100. In such embodiment the inner cavity 120 is divided into a storage chamber 122 and a loading chamber 124. A divider or barrier 126 is located in the cavity 120 to separate the storage chamber 122 from the loading chamber 124. The barrier 126 may be a separate piece inserted into the cavity 120, or may be an integral portion of the unitary structure forming the toothbrush body 102 or handle portion 104.

The storage chamber 122 serves to store a plurality of single dose dentifrice capsules 132, such as in a line along the longitudinal axis. The dentrifice capsules 132 are inserted through the opening 128 into the chamber 122 for storage. The opening 128 is closed by a closing structure 130. Illustrated is a plug that mates with the opening 128 to close the cavity 120 so as to prevent any stored capsules 132 from falling out of the toothbrush 100. The plug may be made of an elastomer or other material adapted to withstand repeated insertion and removal. In some embodiments the plug may be made of a rigid material and be threaded to screw into an opening 128 having corresponding threads. In still other embodiments the closing structure 130 may be a hinged door formed as part of the handle portion 104 and that clicks into and out of a locking position.

The loading chamber 124 is located more distal than the storage chamber 122 and extends from the handle portion 104 into the head portion 106. Along a side surface 111 of the handle portion 104 is an opening 142. In some embodiments the opening 142 has no cover so as to remain open at all times. In other embodiments the opening 142 is closed by a cover 144, such as a hinged door or a separate detachable cover piece. A single dentrifice capsule 140 is inserted through the opening 142 into a lower portion 148 of the loading chamber 124 along the handle portion 104. The dentrifice capsule 140 is moved within the loading chamber 124 to the head portion 106, then collapsed to release the dentrifice from within the capsule 140. The head portion 106 includes an opening 146 at the front surface 117 among the tooth cleaning elements 116. When the capsule 140 is collapsed, the dentrifice 150 exits through the opening 146 to the tooth cleaning elements 116. (See FIGS. 1 and 3.) The loading process and related structures are described in more detail below.

Figure 3:
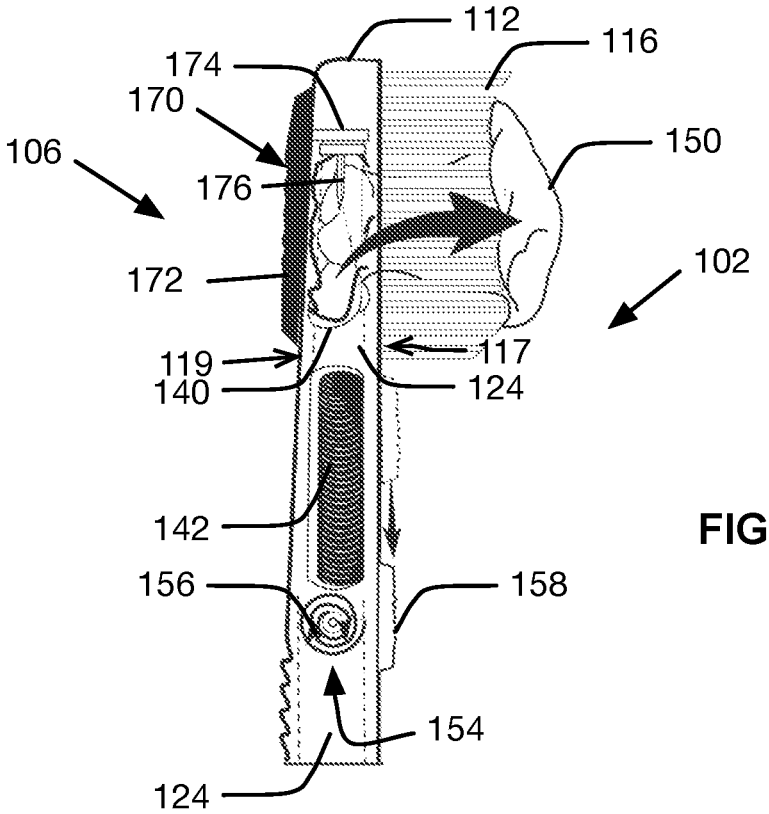
FIG. 3 is a side view of the upper portion of the toothbrush brush of FIG. 1 feature with the pin and crushed dentrifice capsule at the upper portion of the loading chamber revealed, and the roller at the lower portion of the loading chamber revealed.

Referring to FIG. 3, an upper portion of the toothbrush body 102 is illustrated, with the upper portion of the loading chamber 124 revealed to show a collapsed capsule 140 therein, along with a sharp pointed protrusion for perforating the outer wall material of the capsule 140. The remainder of the loading chamber 124 and inner cavity 120 are shown in phantom view.

Figure 4A:
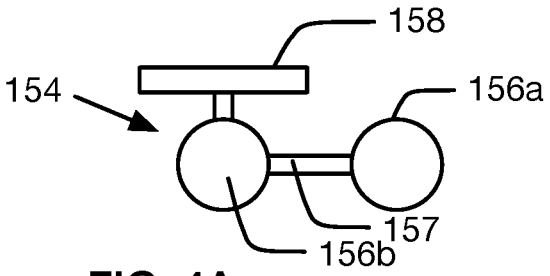
FIG. 4A is a schematic side view of the advancing mechanism of the toothbrush of FIG. 1, in accordance with an embodiment of the present invention.
Figure 4B:
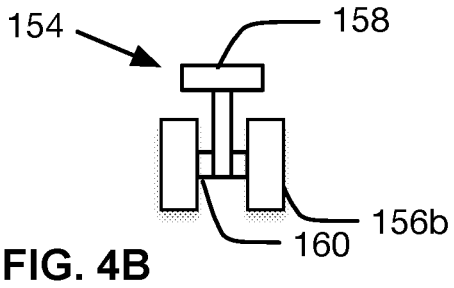
FIG. 4B is a schematic view of the advancing mechanism of FIG. 4A, viewed from proximally as extending along the toothbrush longitudinal axis, in accordance with an embodiment of the present invention.

In an exemplary embodiment, the toothbrush 100 includes an advancing mechanism 154 that moves the loaded capsule 140 from a lower portion 148 of the loading chamber 124 to a more distal upper portion 152 (see FIG. 2) of the loading chamber 124 in the head portion 106. Referring to FIGS. 3, 4A, and 4B, an embodiment of the advancing mechanism 154 includes one or more roller sets 156 (e.g., 156*a,b*) and a slider grip 158. The rollers rotate about an axis defined by an axle 160. The slider grip 158 is coupled to the axle 160 by a frame 157 to move the entire advancing mechanism 154 longitudinally within the loading chamber 124. A user places their finger on the slider grip 158 and pushes the slider grip 158 along a track 162 (see FIG. 1) to advance the advancing mechanism 154 longitudinally. During longitudinal movement the rollers 156 roll within the loading chamber 124. FIGS. 1 and 3 show the advancing mechanism 154 in an initial retracted position. FIG. 3 also shows in phantom the slider grip 158 for when the advancing mechanism 154 is advanced distally to move the capsule 140 to a position behind the brush cleaning elements 116 in the toothbrush head 106. Longitudinal motion of the advancing mechanism 154 in FIG. 4A is to the left and right in the plane of the drawing sheet. Longitudinal motion of the advancing mechanism 154 in FIG. 4B is into and out of the plane of the drawing sheet. In the illustrated embodiment the frame 157 positions the rollers 156 more distal than the sliding grip 158, so as to allow the advancing mechanism to advance the capsule 140 into the head portion 106 and collapse the capsule 140. The relative location of the rollers 156 and siding grip 158 along the longitudinal axis 109 will vary according to the embodiment so as to be able to collapse the capsule 140 between the rollers 156 and a distal barrier structure 174.

Figure 5A:
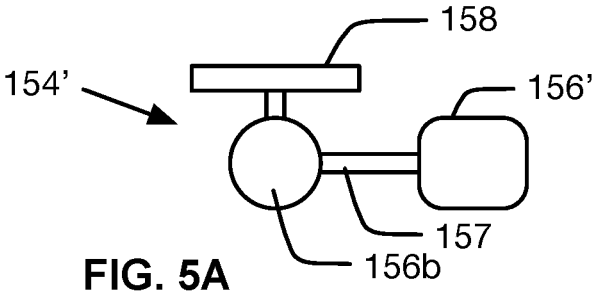
FIG. 5A is a schematic side view of the advancing mechanism of the toothbrush of FIG. 1, in accordance with another embodiment of the present invention.
Figure 5B:
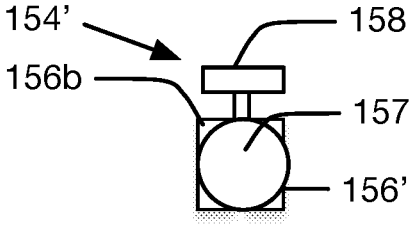
FIG. 5B is a schematic view of the advancing mechanism of FIG. 5A, viewed from proximally as extending along the toothbrush longitudinal axis, in accordance with another embodiment of the present invention.

Referring to FIGS. 5A and 5B, in an alternative embodiment the advancing mechanism 154' includes a piston 156' coupled to the slider grip 158, in addition to rollers 156*b* and an axle. The piston 156' moves within the inner cavity 120, and more specifically within the loading chamber 124 along the same path as for the roller embodiment. Longitudinal motion of the advancing mechanism 154' in FIG. 5A is to the left and right in the plane of the drawing sheet. Longitudinal motion of the advancing mechanism 154' in FIG. 5B is into and out of the plane of the drawing sheet. In the illustrated embodiment the frame 157 positions the piston 156' more distal than the sliding grip 158, so as to allow the advancing mechanism to advance the capsule 140 into the head portion 10 and collapse the capsule 140. The relative location of the piston 156' and the siding grip 158 along the longitudinal axis 109 will vary according to the embodiment so as to be able to collapse the capsule 140 between the piston 156' and a distal barrier structure 174.

Figure 2:
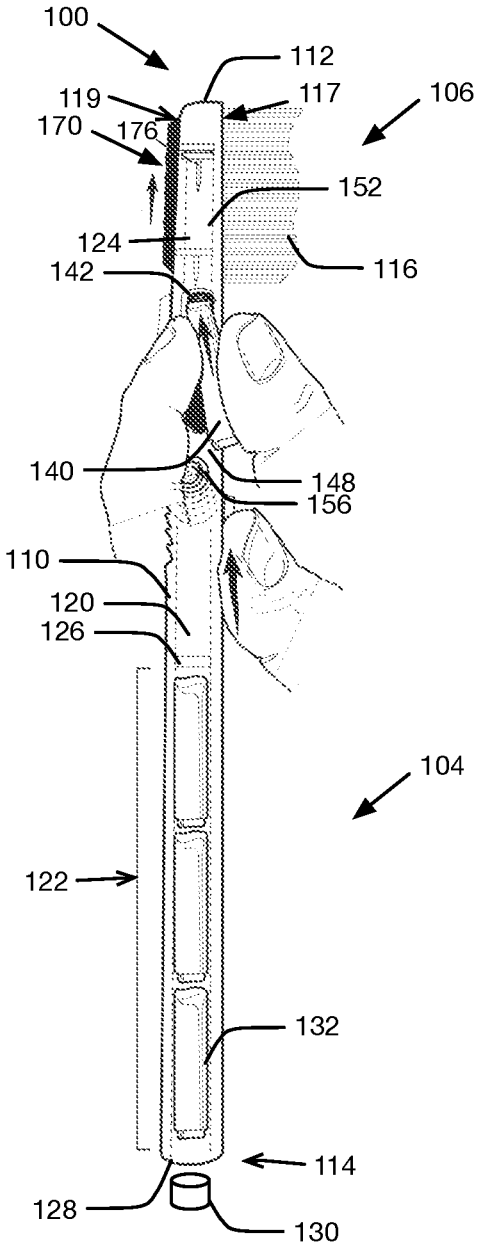
FIG. 2 is a side view of the toothbrush of FIG. 1 with a pin at the upper portion of the loading chamber revealed and with dentrifice capsules stored in the storage chamber revealed.
Figure 6:
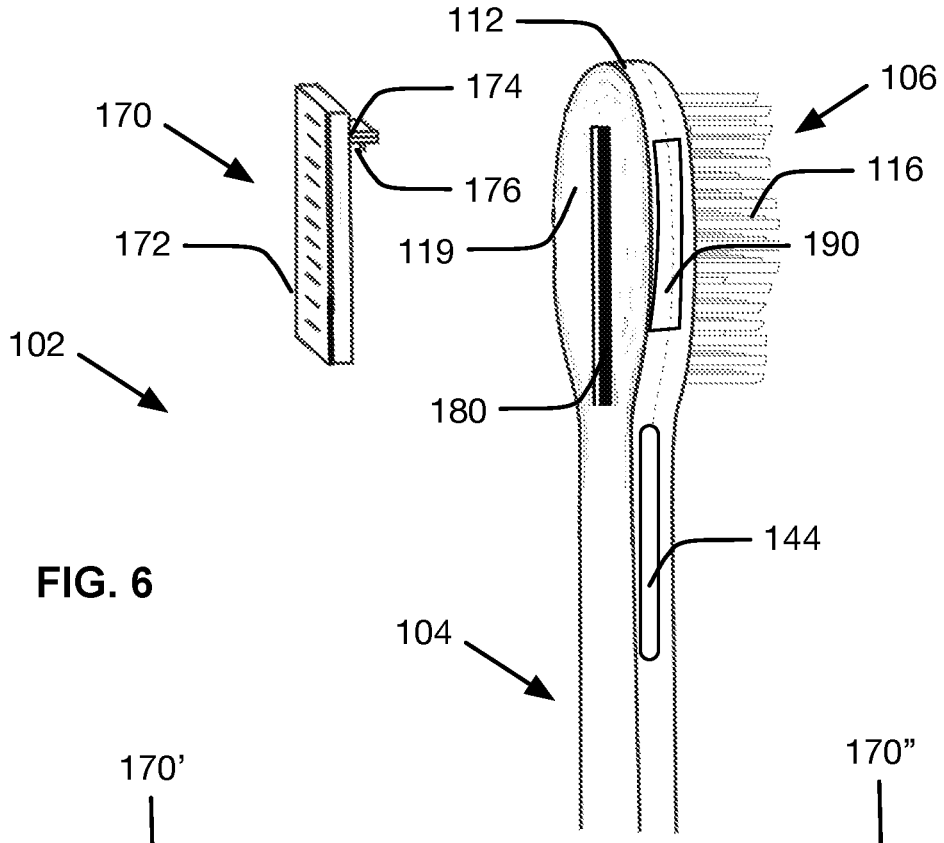
FIG. 6 is an exploded perspective view of the upper portion of the toothbrush of FIG. 1, in accordance with an embodiment of the present invention.
Figure 7A:
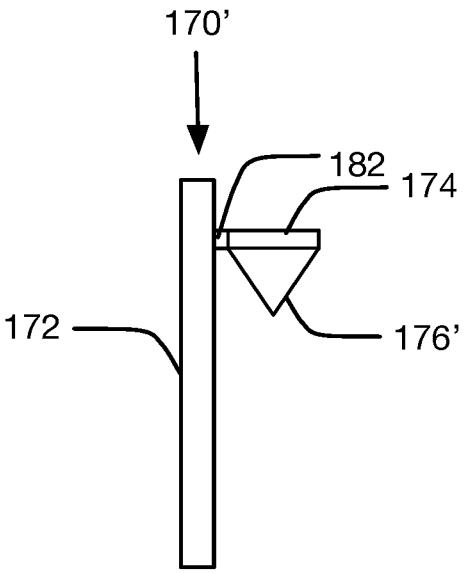
FIG. 7A is a schematic side view of a movable barrier structure for puncturing a dentrifice capsule loaded within the loading chamber of a toothbrush, in accordance with another embodiment of the present invention.
Figure 7B:
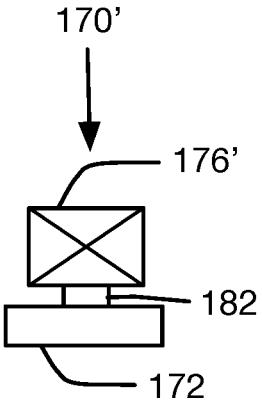
FIG. 7B, is a schematic view of the movable barrier structure for puncturing a dentrifice capsule loaded within the loading chamber of the toothbrush of FIG. 7A, viewed from proximally as extending along the toothbrush longitudinal axis, in accordance with an embodiment of the present invention.
Figure 8:
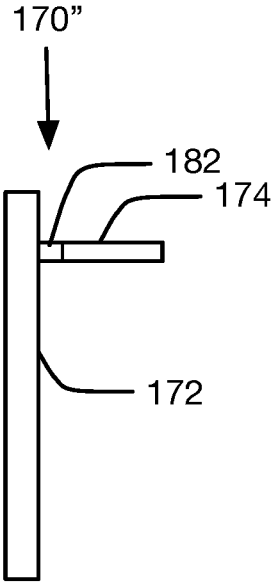
FIG. 8 is a schematic side view of another embodiment of a movable barrier structure for collapsing a dentrifice capsule loaded within the loading chamber, in accordance with an embodiment of the present invention.

Referring to FIG. 6, an upper portion of the toothbrush body 102 is illustrated, with a movable barrier mechanism 170 shown uninstalled from the head portion 106. The movable barrier mechanism 170 includes a slider grip 172 portion and the barrier structure 174 portion. The barrier structure protrudes from an underside of the slider grip 172 at or towards a distal end of the slider grip 172. In various embodiments, the barrier structure 174 has a generally pointed structure 176 mounted to or formed as part of the barrier structure 174. Although FIGS. 2, 3, and 6 illustrate the pointed structure 176 as being a pin-like structure, in other embodiment the pointed structure may vary to be conical, pyramid-shaped, wedge shaped, or another pointed or anvil-like shape to aid in puncturing the capsule 140. For example, a point (e.g., as for a pin or cone) or a pointed edge (e.g., as for a wedge) may be formed. Alternatively, the pin-like tip may instead be blunted, or be a blunt face. FIGS. 7A and 7B depict a movable barrier mechanism 170' having a barrier portion 174' with a pyramid-shaped structure 176'. In still other embodiments, the barrier portion 174 need not have a pointed structure, but instead may be blunted or have a flat face, such as shown for barrier portion 174 of the movable barrier mechanism 170" of FIG. 8.

Referring to FIG. 6, any of the various embodiments of the movable barrier mechanism 170 (or 170', 170") slide along a track opening 180 at the rear face 119 of the toothbrush head portion 106. The various embodiments of the movable barrier mechanism include a rail 182 (see FIGS. 7A, 7B and 8) which runs within the track opening 180. The slider grip 172 and the barrier structure 174 are wider than the rail 182 so as to keep the rail 182 in the track opening 180. In some embodiments, the track opening 180 has a wider portion (not shown) at either a distal or proximal end of the opening 180 so as to allow for removal and or re-installation of the movable barrier mechanism 170.

In an exemplary embodiment, the slider grip 172 has a longitudinal length greater than or approximating the longitudinal length of the track opening 180. By having such a length, the slider grip portion 172 covers the track opening 180 while the slider grip portion 172 is at its most distal position toward the distal end 112 of the toothbrush 100. Also, the roller 156 and piston 156' have an outer dimension that generally conforms to cross section of the inner channel 220 so as to prevent or limit dentrifice from passing proximally beyond the advancing member 254 when the single dose capsule 150 is collapsed between the advancing member 254 and the barrier structure 274.

Referring to FIGS. 1-3, the loading and usage of the toothbrush 100 is now described. To use a capsule stored in the toothbrush, the user removes the closing structure 130 (e.g., plug) from the proximal end 114 of the toothbrush 100 and removes a capsule from among capsules 132 stored in the storage chamber 122. The closing structure 130 then is re-inserted to close the storage chamber 122.

To load the capsule into the loading chamber 124 for usage, the door 144 in the side of the toothbrush body 102 is opened (or in another embodiment a cover (in place of the door 144) is removed.) In some embodiments, there is no covering to the opening 142 to the loading chamber 124, so that the opening 142 is always exposed and the loading chamber therein is always accessible. The capsule 140 is loaded through the opening 142 into the loading chamber 124, while the advancing mechanism 154 is in the retracted proximal position shown in FIGS. 1 and 2). Accordingly, the capsule 140 is positioned in the loading chamber distal to the roller 156 (or piston 156'.)

The user then places their finger on the slider grip 172 of the movable barrier mechanism 170 and moves the barrier mechanism 170 proximally toward the handle portion 104 of the toothbrush 100, until the proximal end of the track opening 180 is reached, or until further proximal movement is blocked by the capsule 140. In some embodiments, after the the barrier mechanism 170 makes contact with the capsule 140, the user continues to move the barrier mechanism 170 so as to puncture the capsule 140 with the generally pointed structure 176 or other structure, as per the embodiment.

Next, the user moves the capsule 140 distally into the head portion 106, by placing their finger on the slider grip 158 of the advancing mechanism 154 and advancing the slider grip 158 in the distal direction. The rollers 156 or piston 156' abut the capsule 140 and are part of the advancing mechanism 154. Accordingly, as the slider grip 158 is moved distally the roller or piston moves the capsule 140 into the toothbrush head portion 106 behind the tooth cleaning elements 116. As the user moves the slider grip 158 of the advancing mechanism 154, the barrier mechanism 170 in contact with the capsule 140 also is moved distally under the force communicated through the advancing mechanism 154 and capsule 140. In particular, the slider grip 158 moves distally within track 162 by the user's finger. Correspondingly, the rail 182 of the movable barrier mechanism 170 moves distally along track opening 180 by force conveyed through the advancing mechanism 154 and capsule 140. Before the slider grip 158 reaches the distal end of slider track 162, the barrier mechanism 170 reaches the distal end of its path. In particular, the barrier mechanism can move no further in the distal direction. Therefore, when the user continues pushing the slider grip 158 of the advancing mechanism 170 further in the distal direction, the capsule 140 is collapsed between the roller(s) 156 (or piston 156') and the barrier portion 174 (or more specifically, the pointed structure 176/176', if present, of the barrier portion 174.) The dentrifice 150 within the capsule 140 is thereby squeezed out of the capsule 140 as the capsule is collapsed under the force exerted by the user in the distal direction at the slider grip 158. Because the volume the capsule 140 occupies is closed (i) by the slider grip 172 of the barrier mechanism 170 at the rear surface 119 of the head portion 106, (ii) by the roller 156 or piston 156' at the proximal end of the capsule, and (ii) by the barrier structure 174 at the distal end of the capsule, (iv) the dentrifice is forced out the opening 146 at the front face 117 of the toothbrush head portion 106 at the base of the teeth cleaning elements 116. The dentrifice is forced out to be among the tooth cleaning elements.

With the dentrifice now among the teeth cleaning elements 116, the user can brush their teeth using the toothbrush 100 and the single dose of dentrifice 150 forced from the capsule 140.

To unload the collapsed capsule 140, the barrier mechanism 170 and advancing mechanism 154 are moved back in the proximal direction so that the collapsed capsule 140 is moved from the upper portion of the loading chamber back toward or into the lower portion of the loading chamber 124. For example, the user may place their finger on the slider grip 172 of the barrier mechanism 170 and slide proximally so that the rail 182 moves proximally in the track opening 180. The force applied in the proximal direction at the slider grip 172 is communicated through the capsule 140 to the rollers 156 or piston 156' thereby moving the advancing mechanism backwards. Thereby, the slider grip 158 of the advancing mechanism also is moved back toward its starting position. The slider grip 158 then may be moved further in the proximal direction to reach its initial starting position for loading capsules. Alternatively, instead of forcing the slider grip 172, the slider grip 158 of the advancing mechanism 154 may be moved by the user proximally along track 162. The collapsed capsule 140 is removed through the opening 142 once the capsule has been moved proximally enough for the user to grip and remove the collapsed capsule. The user also can simply shake the toothbrush 100 to force the collapsed capsule 140 out of the opening 142 once the capsules been moved back to the lower portion 148 of the loading chamber 124. Of course, any combination of the above movements can be used to remove the collapsed capsule 140.

Figure 9:
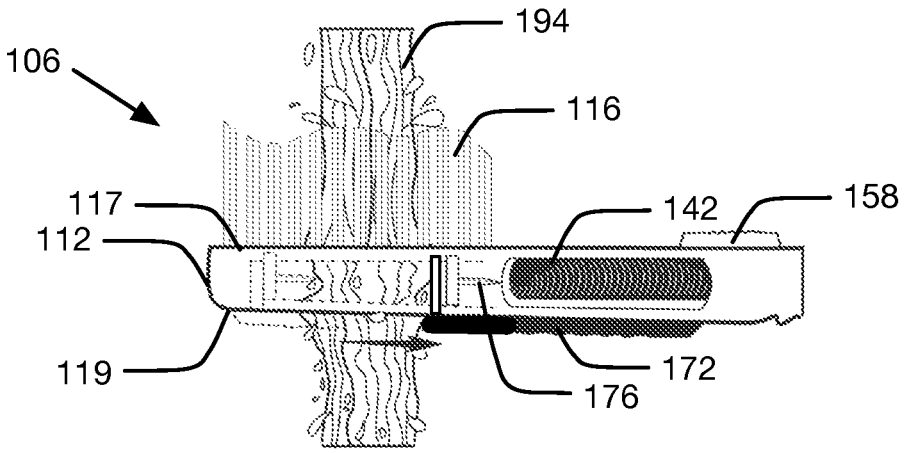
FIG. 9 is a partial view of the upper portion of the toothbrush of FIG. 1 configured for being washed (without the side door), in accordance with an embodiment of the present invention.
Figure 10:
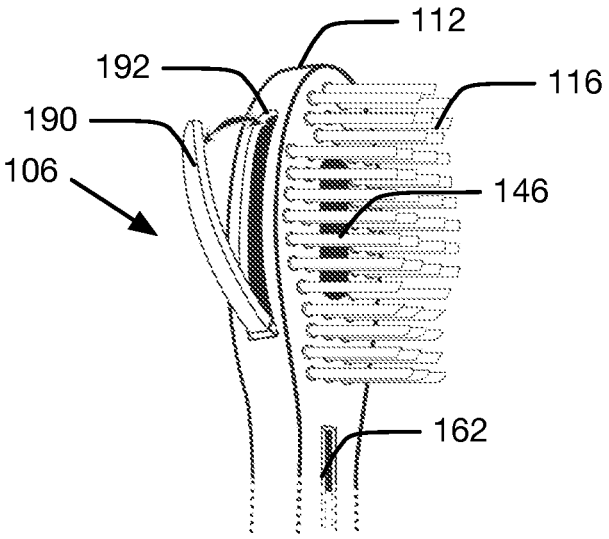
FIG. 10 is a perspective view of the top portion of a toothbrush having a side door for facilitating washing of the toothbrush interior, in accordance with an embodiment of the present invention.
Figure 11:
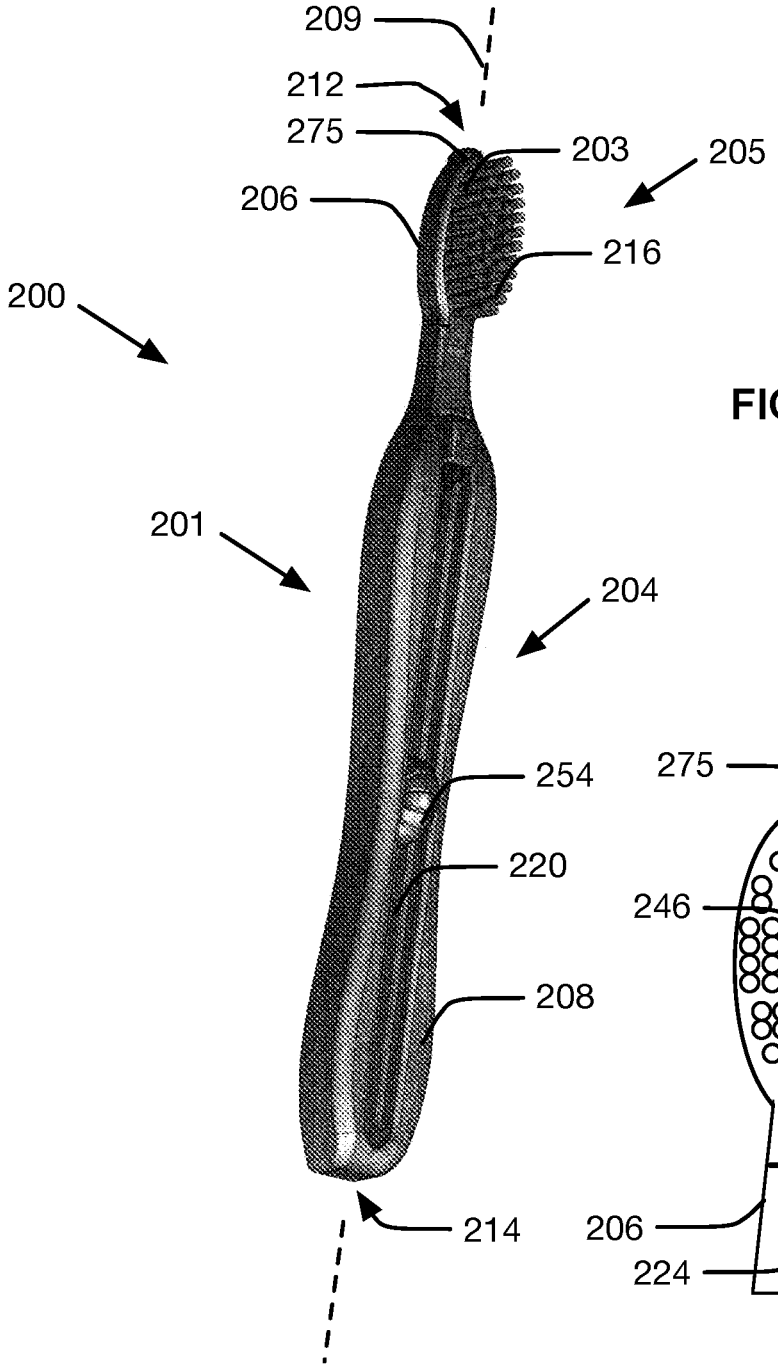
FIG. 11 is a perspective view of a toothbrush, in accordance with another embodiment of the present invention
Figure 12:
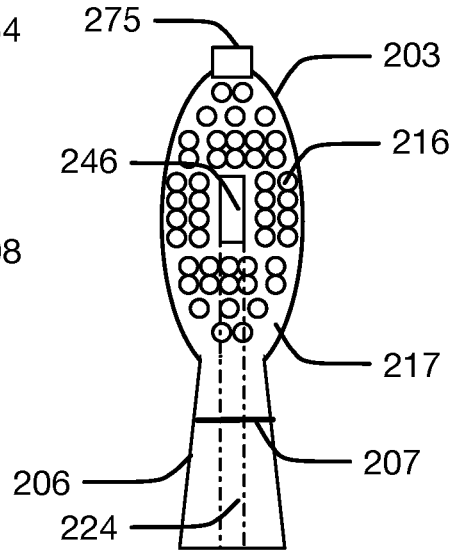
FIG. 12 is a plan view of the bristle face side of an upper portion of the toothbrush in accordance with the embodiment of FIG. 11.

Although dentrifice is driven from the capsule 140 through the opening 146 to the tooth cleaning elements 116 when collapsing the capsule 140, there may be residual dentrifice left in the loading chamber 124. The user may run water through the opening 146 and the track 180 to clean the upper portion of the loading chamber 124, such as shown in FIG. 9. In some embodiments, such as shown in FIG. 10, the toothbrush 100 includes a door 190 at a side surface of the toothbrush head portion 106. The door 190, for example, is hinged, and may be moved into and out of an open position.

The door, for example, clicks into a closed position to remain securely closed. A grip on the door 190 or separation at the door enclosure allows a user to move the door 190 out of the clicked engaged position using a fingernail or instrument. With the door 190 open, the user runs water over the brush head portion 106 so as to clean the tooth cleaning elements 116. Water 194 also may be directed through the opening 146 in the head portion 106 to access the loading chamber 124. The water 194 flows out the opening 192 left by the open door 190. Further, by positioning the barrier mechanism 170 at its most distal position, water also flows out through the openings 162 and/or 142 to clean the lower portion of the loading chamber 124. Of course the water can be driven in the opposite directions also through the various openings in the toothbrush head portion 106 and handle portion 104.

A capsule is elongated and may be ellipsoidal or cylindrical so as to have rounded or flat ends. The capsule is made of a material compatible with dentrifice and suitable for storing products to be used orally. For example, cellulose or other materials used in forming capsule for dietary supplements may be used. Thin plastic materials also may be used, since the capsule is not being ingested. In some embodiments the capsule may have perforations to make breaking the capsule easier when the capsule is collapsed by the pressure applied between the rollers 156 and barrier portion 174. In another embodiment the capsule is elongated and includes a thin foil or thin plastic covering (e.g., membrane) at the distal end which may be more easily punctured by the barrier structure 174, and which may more easily move aside as the dentrifice 150 is forced from the capsule when the capsule is being collapsed. In some embodiments the covering has a different material composition than longitudinal walls of the single dose capsule. In other embodiments the covering has a different wall thickness than longitudinal walls of the single dose capsule. In other embodiment the capsule has a uniform wall thickness and uniform wall material composition.

Second Toothbrush Embodiments

Referring to FIGS. 11-20, a toothbrush 200 is illustrated in accordance with alternative embodiments of the present invention. The toothbrush 200 generally includes an elongated body 201 formed by a handle portion 204 and a brush head portion 205. The brush head 205 includes a base support portion 206 and a bristle frame portion 203. Tooth cleaning elements 216 (e.g., bristles) extend from the bristle frame portion 203. The toothbrush 200 is intended to be used in a manner that the tooth cleaning elements 216 clean a user's teeth. Although the illustrated toothbrush 200 is in the form of a manual toothbrush, in other embodiments the toothbrush 200 may be a powered toothbrush.

The body 201 of the toothbrush 200 generally extends along a longitudinal axis 209 from a proximal end 214 to a distal end 212. Because the body 201 may, in certain embodiments, be a non-linear structure, the longitudinal axis of the body 201 may also be non-linear in certain embodiments. However, the invention is not to be so limited in all embodiments, and in certain other embodiments the body 201 may have a simple linear arrangement and thus a substantially linear longitudinal axis.

The handle portion 204 of the toothbrush 200 is an elongated structure extending from the proximal end 214 to the toothbrush brush head portion 205. The handle portion 204 provides the mechanism by which the user can hold and manipulate the toothbrush 200 during use. The handle portion 204 includes an outer surface that includes a front surface 208 and an opposing rear surface 210 (See FIG. 16). In the exemplified embodiment, the handle portion 204 is generically depicted as being straight. However, in other embodiments the handle portion 204 may have contours for user comfort.

In the exemplified embodiment, the handle portion 204 is formed of a rigid plastic material, for example metals, fiberglass, polymers and copolymers of ethylene, propylene, butadiene, vinyl compounds and polyesters such as polyethylene terephthalate. In other embodiments the handle portion 204 can be formed of any material that is not incompatible with the dentrifice that is stored therein. The handle portion 204 also may include a resilient material, such as a thermoplastic elastomer, as a grip cover that is molded over portions of or the entirety of the handle portion 204 to enhance gripping of the handle portion 204 during use. For example, portions of the handle portion 204 that are typically gripped by a user's palm during use may include a thermoplastic elastomer or other resilient material to further increase user comfort.

Figure 16:
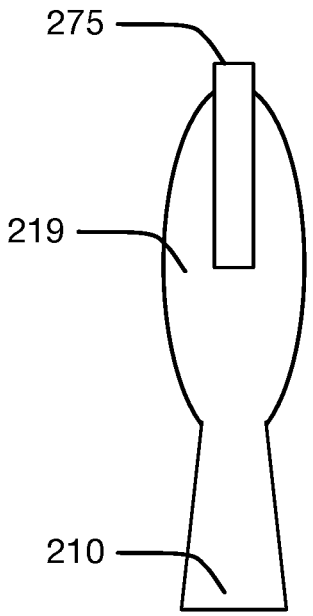
FIG. 16 is a plan view of back side of an upper portion of the toothbrush in accordance with the embodiment of FIG. 11 showing the latch in a locked position.

The head portion 205 of the toothbrush 200 is coupled to the handle portion 204 and includes a front surface 217 (FIG. 12) and an opposing rear surface 219 (FIG. 16). In the exemplified embodiment, the base support portion 206 is formed integrally with the handle portion 204 as a single unitary body 201 using a molding, milling, machining or other suitable process. In another embodiment, it is the bristle frame portion 203 that instead is formed integrally with the handle portion 204 as a single unitary body 201 using a molding, milling, machining or other suitable process. In still other embodiments the handle portion 204 and either one or both of the brush head portion 205 (i.e., the base support portion 206 and the bristle frame portion 203) may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Typically, the head portion 205 is formed by any of the materials described above for the handle portion 204.

The bristle frame portion 203 of the toothbrush 200 has a plurality of tooth cleaning elements 216 (e.g., bristles) extending from the front surface 217. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 216 are connected to the bristle frame portion 203 in any manner known in the art. For example, staples/anchors, in-mold tufting (IMT) or anchor free tufting (AFT) could be used to mount the cleaning elements/tooth engaging elements to the bristle frame portion 203. In AFT, a plate or membrane having tuft holes therein is formed separately from the body 201 of the toothbrush 200. Bristles or other tooth cleaning elements are positioned within the tuft holes. The free ends of the bristles on one side of the plate or membrane perform the cleaning function. The ends of the bristles on the other side of the plate or membrane are melted together by heat to be anchored in place. After the bristles are properly coupled to the head plate, the head plate is secured to the brush head such as by ultrasonic welding.

In an exemplary embodiment the toothbrush 200 has an exposed groove 220 along the handle portion 204 extending toward the brush head portion 205. The groove 220 serves as storage space for a dentifrice container 232 (FIGS. 13-14), such as in a line along the longitudinal axis 209. The length, depth and width of the groove 220 are prescribed so as to fit a dentrifice container 232 of a size that stores one or more doses of dentrifice 234 (FIG. 14). In a preferred embodiment the container 232 stores one dose. In another preferred embodiment, the contained 232 stores 2 doses. In still another preferred embodiment the container 232 stores 3 doses. It is preferable that the number of doses be limited to 6 or less so that the container 232, groove 220 and handle portion 204 are not too bulky, but instead result in a toothbrush 200 of a comfortable ergonomic size suitable for travel.

Figure 13:
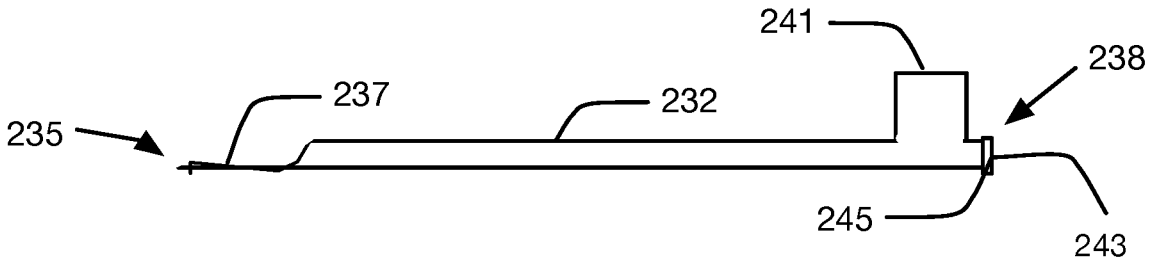
FIG. 13 is a plan view of a dentrifice container for use with the toothbrush embodiment of FIG. 11.
Figure 14:
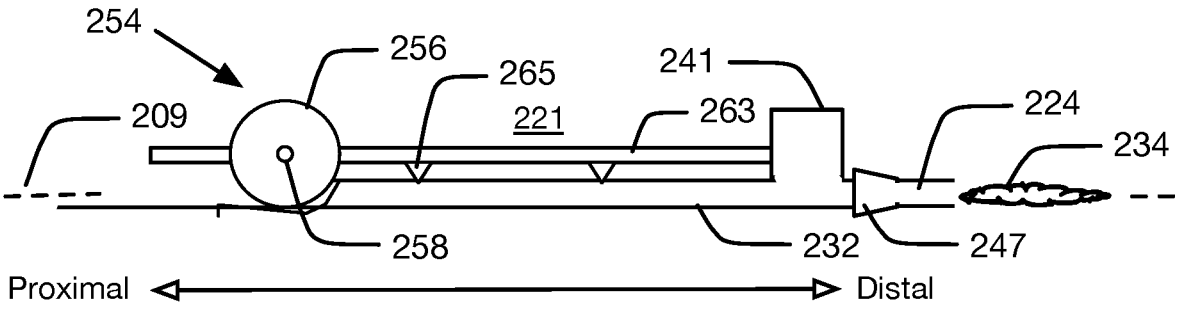
FIG. 14 is a diagrammatic view of the pushing member having an axle that moves along a track, while the dentrifice container is situated in the groove of the toothbrush in accordance with an embodiment of this invention.

In an exemplary embodiment as shown in FIGS. 13 and 14, the dentrifice container 232 is an elongated cylinder filled with dentrifice 234. In some embodiments the container 232 has a cross section in the shape of a half circle, so as to rest flat along a floor of the groove 220. At a proximal end 235, the container 232 has a flat portion 237. At the opposite end 238 the container 232 has a bulbous handle 241 which allows a user to grip the container 232 at the handle 241 to insert and extract the container 232 from the groove 220. The dentrifice 234 is forced out through an opening 243 at the end 238 of the container 232. A foil or other membrane 245 covers the opening 243 prior to use. A user peels off the foil, and inserts the container 232 into the groove 220 for use. The end 238 fits into an opening 247 of the channel 224. The channel 224 extends through the body 201 from the handle portion 204 into the head portion 205. A portion of the channel 224 extends through the head portion to an opening 246 in the front face 217 of the bristle frame portion 203. A distal portion of the channel 224 extends in a space defined between the base support portion 206 and the bristle frame portion 203. The channel 224 ends at the opening 246 in the front face 217 of the bristle frame portion 203, so that the dentrifice 234 exits opening 246 to reside among the bristles 216.

Figure 15:
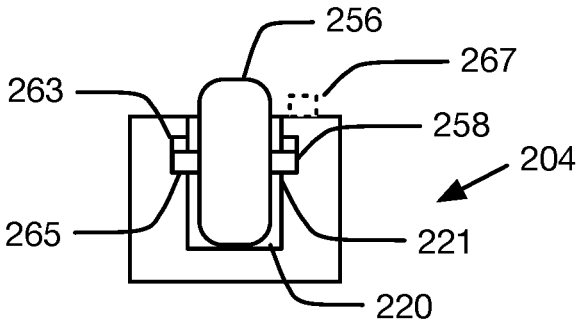
FIG. 15 is a cross sectional diagrammatic view of the handle portion of a toothbrush having alternative metering guide embodiments for aiding in the dispensing of dentrifice, (e.g., a wheel has an axle dropped into a recess (i.e., metering guide) along a track in the sidewalls of a groove in the handle portion; a bump (i.e., metering guide) on the front face of the handle portion).

A pushing element 254 is positioned in the groove 220. Referring to FIGS. 14 and 15, in an exemplary embodiment the pushing element 254 includes a wheel 256 that is rolled along the channel 220 by a user's finger. The wheel 256 includes an axle 258. Each end of the axle 258 protrudes into a respective track 263 defined in each of two sidewalls 221 of the groove 220. When the container 232 is to be installed the wheel 256 is located toward the proximal end 214 of the handle portion 204. The membrane 245 is removed from the end 238 of the container 232. The bottom end 235 of the container at the flat portion 237 is slid under the wheel 256. The container 232 then is slid distally so that the end 238 is mated into the opening 247 of the channel 224. The container 232 is now loaded and ready for use.

To dispense dentrifice 234 to the bristles 216, the user rolls the wheel 256 with their finger in the distal direction so as to squeeze the dentrifice distally out of opening 243, into the opening 247, through the channel 224, and out of the opening 246. In some embodiments, the handle portion 204 is configured to meter the doses of dentrifice 234, such as for a toothbrush 200 and dentrifice container 232 configured to dispense a plurality of doses. For example, in some embodiments one or more bumps 267 (FIG. 15) are positioned on the handle portion 204 adjacent to the groove 220 at intervals from the distal end 214. Each interval corresponds to the dispensing of a single dose. As the user moves the wheel 256 distally squeezing the dentrifice forward, the user's finger encounters a bump to hapticly detect completion of the dispensing of one dose. To dispense another dose, the user advances the wheel 256 from the first bump 267 until the user feels the next bump. In this manner, the user can meter the doses so as to use a prescribed amount of dentrifice, and thereby avoid using excess dentrifrice. The final dose is dispensed when the wheel reaches the handle of the container 232 toward the end of the groove 220. In another embodiment, a bump or a recess 265 is located along the track 263. The axle 258 rolls over the bump or into the recess 265 along the track 263 so as to provide haptic feedback to the user indicating that a dose has been dispensed. The bumps 267 or recesses 265 are spaced at intervals corresponding to the dispensing of a single dose. FIG. 14 shows two sets of recesses 265 spaced at intervals so as to correspond to a container 232 for dispensing three doses. The first dose is metered by the most proximal recess 265. The second dose is metered by the most distal recess 265. The third dose is metered by the wheel 256 reaching the handle 241 near the distal end of the groove 220.

Figure 17:
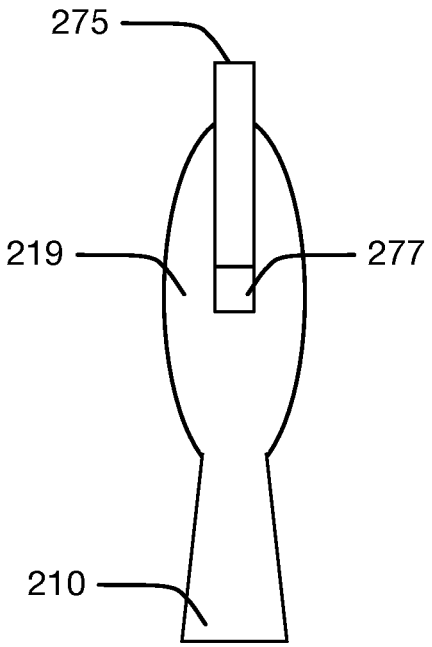
FIG. 17 is a plan view of back side of an upper portion of the toothbrush in accordance with the embodiment of FIG. 11 showing the latch in an unlocked position.
Figure 18:
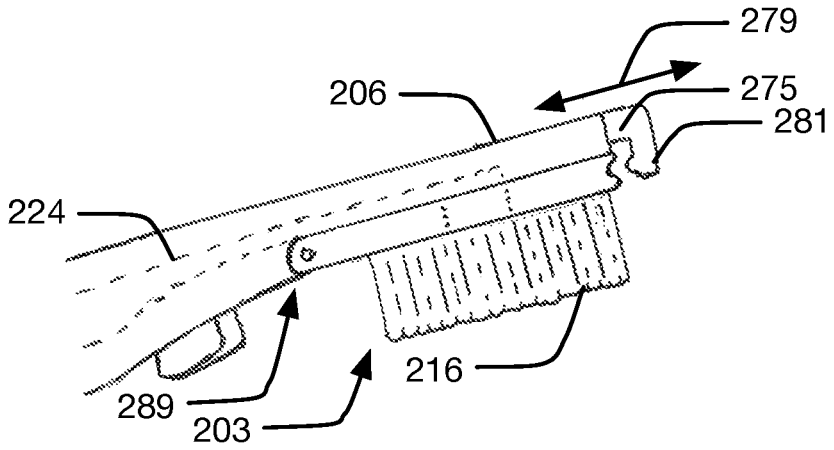
FIG. 18 is a perspective side of the upper portion of the toothbrush in accordance with the embodiment of FIG. 11 showing the bristle frame portion in a locked position.
Figure 19:
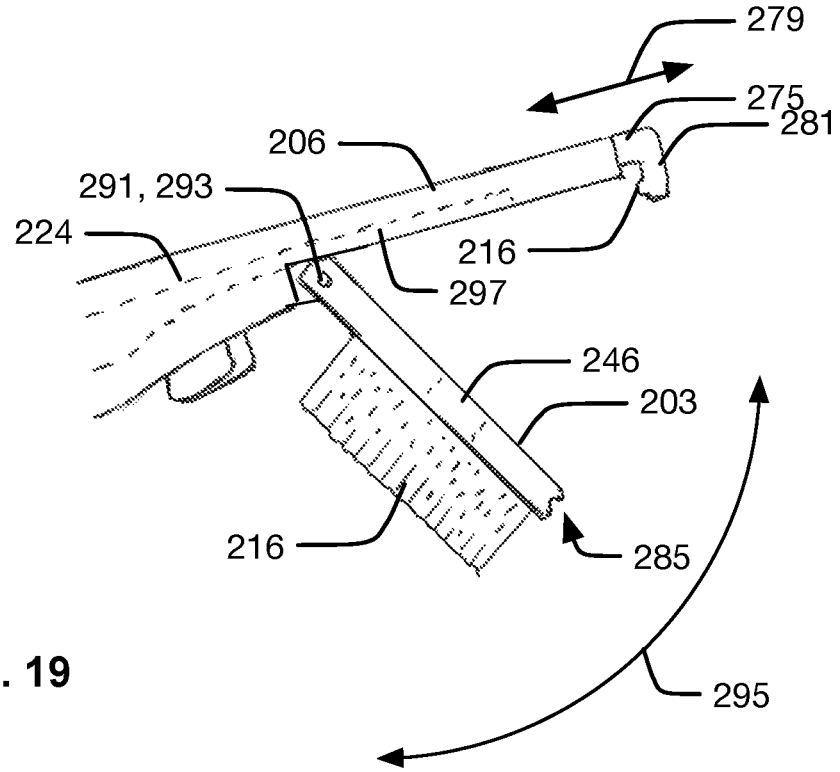
FIG. 19 is a perspective side of the upper portion of the toothbrush in accordance with the embodiment of FIG. 11 showing the bristle frame portion rotated about a hinge while the latch is in the unlatched position.

Occasionally it is desirable to clean the toothbrush channel 224. To do so, the dentrifice container 232 is removed. In addition, the channel 224 is exposed to make cleaning easier. For example, in some embodiments the bristle frame portion 203 is hinged to the base support portion 206. A latch 275 locks the bristle frame portion 203 to the base support portion 206. The latch 275 moves along a groove 277 on the rear surface 219 of the base support portion 206. FIG. 16 shows the latch 275 in a position where the bristle frame portion 203 is secured to the base frame portion 206. FIGS. 17-19 shows the latch 275 in a position where the bristle frame portion 203 is not secured at the distal end 212 to the base support portion 206. The latch 275 is movable from the latched position to the unlatched position, and from the unlatched position too the latched position as indicated by the arrows 279. In an example embodiment, the distal end of the latch 275 has an L-shape with an arm portion 281 extending toward the bristle frame portion 203. A protrusion 283 extends proximally from the arm 281. When the latch 275 is in the latched position, the protrusion 283 extends into a recess 285 at the distal end of the bristle frame portion 203. When the latch 275 is moved out of the latched position, the latch 275, along with its arm 281 are moved distally separating the protrusion 283 from the recess 285.

For the embodiment illustrated in FIGS. 18 and 19, when the latch 275 in the unlocked position, the bristle frame portion 203 is movable relative to the base support portion 206. In one embodiment, a proximal end of the bristle frame portion is connected to the base support portion 206 by a thin flexible strip 207 (FIG. 12), which serves as hinge allowing the bristle frame portion 203 to move about an axis defined by the strip 207. In the embodiments shown in FIGS. 18 and 19, the hinge instead is formed by a male and female coupler 289. In one embodiment a pin 291 extends from the base support portion 206 into a female recess 293 in the bristle frame portion 203 at each side of the bristle frame portion 203. The pin 291 defines an axis of rotation that allows the bristle frame portion 203 to move along an arc 295 while the latch 275 is in the unlatched position. Alternatively, the pin(s) 291 is located on the bristle frame portion 203 and extends into female recess(es) 293, which instead are located on the base support portion 206.

With the bristle frame portion 203 rotated, the inner surfaces of the bristle frame portion 203 and base support portion 206 are exposed. While the latch 275 is in the latched position, such surfaces are in contact and define a portion 297 of the channel 224 therebetween. The user then can easily clean the channel portion 297 and the bristle frame portion's opening 246. In addition, the user can run water and/or extend a pin through the remaining portion of the channel 224 extending to the groove 220 in the handle portion 204. As a result, the toothbrush 200 is easily cleaned.

In an alternative embodiment, the bristle frame portion 203 instead is rigidly coupled to or integrally formed with the handle portion 204, and the base support portion 206 is instead movable relative to the bristle frame portion 203 and handle portion 204 when the latch 275 is in the unlatched position. In such embodiment the base support portion 206 is coupled to the bristle frame portion by the thin flexible strip (analgous to strip 207) or by the coupler 289.

Figure 20:
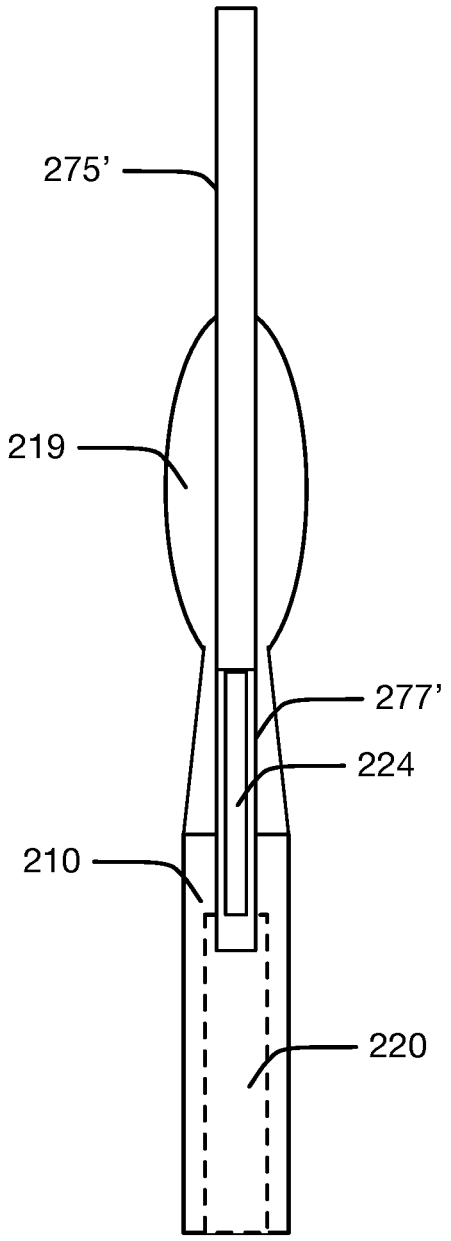
FIG. 20 is a plane rear view of the upper portion of the toothbrush in accordance with another embodiment of the invention.

In still another alternative embodiment as shown in FIG. 20, a latch 275' and groove 277' extend more proximal and extend deeper (compared to the latch 275) into the base support portion 206 to the channel 224. The latch 275' is movable in the distal direction (and in some embodiments removable) to expose the channel 224 for cleaning. In such an embodiment it is preferable that the latch 275' and groove 277' extend in the proximal direction along the back surface 219 of the base support portion 206 and the back surface 210 of the handle portion 204 to a position nearly opposite the groove 220, so as to minimize the length of the channel 224 that is not exposed when the latch 275' is moved distally. FIG. 20 shows the latch 275' moved distally exposing a portion of the channel 224. The groove 277' extends proximally so that its proximal end is be slightly more proximal than the distal end of the groove 220. Accordingly, when the latch 275' is removed or extended distally beyond the opening 246 in the bristle frame portion 203, the entire channel 224 is exposed for cleaning. In such embodiment the base support portion 206 and bristle frame portion 203 are formed together as a head portion and do not hinge relative to each other. Such head portion is formed integrally with the handle portion 204 or as a separate structure.

Although the preferred embodiment described is for a toothbrush, the invention also encompasses other facial, eye and mouth product brushes having a personal care product capsule stored in the handle which is dispensed through an internal channel to the brush head. The capsule stores a single application, or two applications, or three applications, or a limited number of applications, such as used in a day or over a weekend for travel. Further, in some embodiments the brush includes a storage chamber for storing an extra capsule(s) than the capsule installed for dispensing. Further, a brush embodiment configured for dispensing one type of product also may dispense another type of product by loading a container of the other type of product. For example, a container configured the same as described above for storing dentrifice may instead store mouthwash. Accordingly, the brush may dispense alternative mouth care products according to the contents stored in the container in the toothbrush. The containers are substituted to dispense the alternative products. Similarly, a brush having the structural features described herein is configured in a smaller dimension to apply product from a smaller container. The container stores any of makeup, mascara, or eyebrow gel. The brush dispenses one product, then when the container is changed dispenses another type of product. Accordingly, the brush of this invention is configured as a tooth brush, shaving brush, or makeup/mascara/eye-gel brush by changing the size and shape of the handle and brush head while retaining the features for the dispensing mechanism and for facilitating cleaning.

The invention is intended to extend to all functionally equivalent structures, methods and uses, such as are within the scope of the appended claims. Those skilled in the art, having the benefit of the teachings of this specification, may affect numerous modifications thereto and changes may be made in form and details without departing from the scope and spirit of the invention.

What is claimed is:

1. A toothbrush for applying dentrifice from a dentrifice container to teeth of a user, comprising:

a brush head portion and handle portion;

wherein the brush head comprises a base support, a brush head bristle frame, bristles extending from the brush head bristle frame, and a first member movable relative to an axis of the toothbrush;

wherein the handle portion extends longitudinally and has a groove extending longitudinally along an outer surface of the handle portion into which is received the dentrifice container, an end of the groove being in communication with a channel extending through the brush head portion to a first opening in the brush head bristle frame at a location among the bristles;

a pushing member which advances along the groove to push dentrifice from the dentrifice container situated in the groove through the channel and the first opening;

wherein the first member of the brush head has a first position for brushing and a second position for toothbrush cleaning, the channel being exposed for cleaning when the first member is in the second position.

2. The toothbrush of claim 1, wherein the brush head bristle frame is hinged to the base support, the first member locking the brush head bristle frame to base support to prevent movement of the brush head bristle frame relative to the base support when the first member is positioned in the first position, the brush head bristle frame movable relative to the base support when the first member is positioned in the second position.

3. The toothbrush of claim 1, wherein the groove is a first groove and wherein the first member extends within a second groove extending along a backside of the brush head portion to backside of the handle portion opposite the first groove, so that the entire channel is exposed when the first member is moved in a distal direction more distal than the first opening.

4. The toothbrush of claim 1, wherein the handle portion is metered to designate a position of the pushing member along the groove corresponding for dispensing of a first dentrifice dose from the dentrifice container.

5. The toothbrush of claim 4, wherein said position of the pushing member is a first position, and the elongated body being further metered to designate a second position of the pushing member along the groove corresponding to dispensing of a second dentrifice dose from the dentrifice container.

6. The toothbrush of claim 1 wherein the base support comprises a groove within which the first member slides, wherein the first member comprises a hooked portion at a distal end, and wherein the brush head bristle frame comprises a recess at a distal end for receiving the hooked portion for locking the first member in the first position.

7. The toothbrush of claim 1, wherein the pushing member is a wheel having an axle, and wherein the elongated body has a track that receives the axle so as to allow the wheel to move along the groove.

8. The toothbrush of claim 1, wherein the base support has an inner groove facing the bristle frame which defines at least a portion of said channel.

9. The toothbrush of claim 1, in which a second container stores mouthwash, the toothbrush dispensing the mouthwash when the second container is substituted for the dentrifice container.

10. A personal care brush for applying a facial or oral care product from a first container to either the mouth or face of a user, comprising:

a brush head portion and handle portion;

wherein the brush head comprises a base support, a brush head bristle frame, bristles extending from the brush head bristle frame, and a first member movable relative to an axis of the toothbrush;

wherein the handle portion extends longitudinally and has a groove extending longitudinally along an outer surface of the handle portion into which is received the first container, an end of the groove being in communication with a channel extending through the brush head portion to a first opening in the brush head bristle frame at a location among the bristles;

a pushing member which advances along the groove to push the facial or oral care product from the first container situated in the groove through the channel and the first opening;

wherein the first member of the brush head has a first position for brushing and a second position for toothbrush cleaning, the channel being exposed for cleaning when the first member is in the second position.

11. The personal care brush of claim 10, wherein the brush head bristle frame is hinged to the base support, the first member locking the brush head bristle frame to base support to prevent movement of the brush head bristle frame relative to the base support when the first member is positioned in the first position, the brush head bristle frame movable relative to the base support when the first member is positioned in the second position.

12. The personal care brush of claim 10, wherein the groove is a first groove and wherein the first member extends within a second groove extending along a backside of the brush head portion to backside of the handle portion opposite the first groove, so that the entire channel is exposed when the first member is moved in a distal direction more distal than the first opening.

13. The personal care brush of claim 10, wherein the handle portion is metered to designate a position of the pushing member along the groove corresponding for dispensing of a first dose from the first container.

14. The personal care brush of claim 13, wherein said position of the pushing member is a first position, and the elongated body being further metered to designate a second position of the pushing member along the groove corresponding to dispensing of a second dose from the first container.

15. The personal care brush of claim 10, wherein the base support comprises a groove within which the first member slides, wherein the first member comprises a hooked portion at a distal end, and wherein the brush head bristle frame comprises a recess at a distal end for receiving the hooked portion for locking the first member in the first position.

16. The personal care brush of claim 10, wherein the pushing member is a wheel having an axle, and wherein the elongated body has a track that receives the axle so as to allow the wheel to move along the groove.

17. The personal care brush of claim 10, wherein the base support has an inner groove facing the bristle frame which defines at least a portion of said channel.

18. The personal care brush of claim 10, in which the first container stored mascara and a second container stores makeup, the personal brush dispensing the makeup when the second container is substituted for the first container.

* * * * *